US005671887A

United States Patent [19]

Iavarone

[11] Patent Number: 5,671,887

[45] Date of Patent: Sep. 30, 1997

[54] HIGH PRESSURE WATER SPRAYER

[76] Inventor: Moise A. Iavarone, 61 Lantern La., Sayreville, N.J. 08872

[21] Appl. No.: 642,929

[22] Filed: May 6, 1996

[51] Int. Cl.[6] ..... B05B 7/26

[52] U.S. Cl. ..... 239/310; 239/532; 111/7.1; 111/7.2; 47/48.5

[58] Field of Search ..... 239/10, 310, 318, 239/532; 111/7.1, 7.2, 7.3, 7.4; 47/48.5 G, 48.5 M

[56] References Cited

U.S. PATENT DOCUMENTS

| | | | |
|---|---|---|---|
| 2,293,390 | 8/1942 | Hengesbach | 239/310 X |
| 2,302,799 | 11/1942 | Peterson | 111/7.1 X |
| 2,893,334 | 7/1959 | Snyder | 111/7.1 |
| 3,042,314 | 7/1962 | Packard et al. | 239/310 X |
| 3,405,669 | 10/1968 | Nimrick | 111/7.2 |
| 3,447,753 | 6/1969 | Proctor et al. | 239/318 X |
| 4,705,218 | 11/1987 | Daniels | 239/310 X |
| 5,322,085 | 6/1994 | Prothe | 239/310 X |

*Primary Examiner*—Andres Kashnikow
*Assistant Examiner*—Steven J. Ganey

[57] ABSTRACT

A sprayer adapted for use in association with a garden hose, a tree having subterranean roots and liquid fertilizer, the apparatus comprising: a shaft formed in a hollow cylindrical configuration with inboard and outboard ends each including coupling devices; a spray nozzle having an inboard region coupled to the shaft and an outboard region including a plurality of apertures therethrough; a quick connector having an outboard end including coupling devices and being coupled to the shaft, the quick connector having an inboard end including coupling devices and adapted to be coupled to a garden hose; and a regulator disc including an axle affixed thereto, a handle operatively coupled to the axle and regulator disc, in an operative orientation a user coupling the quick connector to a garden hose, the user then activating the apparatus thereby allowing water to flow through the quick connector into the shaft and out through the spray nozzle.

1 Claim, 3 Drawing Sheets

FIG 3
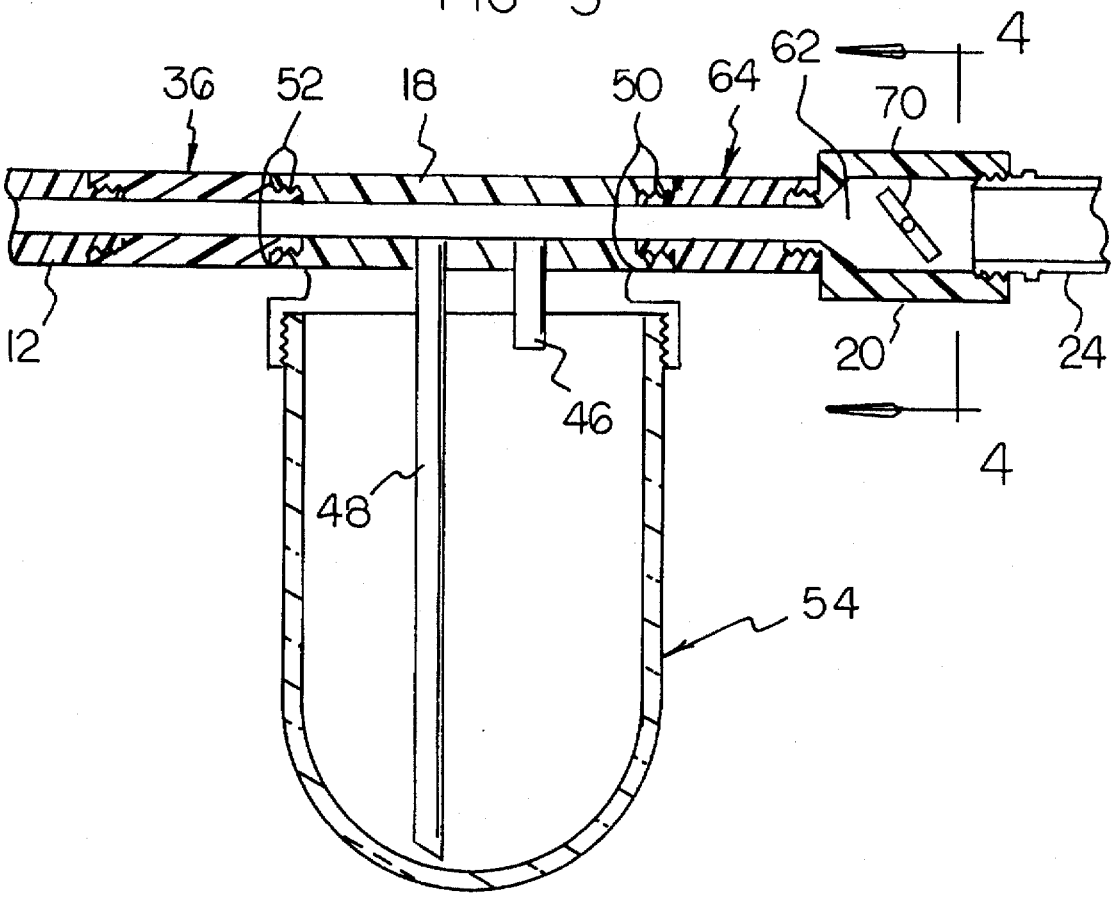
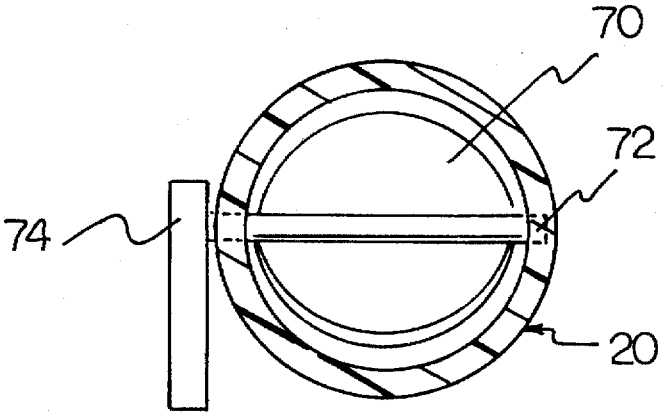
FIG 4

HIGH PRESSURE WATER SPRAYER

BACKGROUND OF THE INVENTION

1. Field of the Invention

The present invention relates to a high pressure water sprayer and more particularly pertains to inserting the shaft of the apparatus underground to deliver water directly to plant and tree roots.

2. Description of the Prior Art

The use of sprayers is known in the prior art. More specifically, sprayers heretofore devised and utilized for the purpose of distributing water are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,512,955 to Etani discloses an apparatus for water treatment.

U.S. Pat. No. 5,301,877 to Madison discloses a lawn and garden sprayer with press-fit nozzle construction.

U.S. Pat. No. Des. 327,528 to Sears et al. discloses a garden sprayer.

U.S. Pat. No. 4,723,437 to McKenzie discloses a sprayer and nozzle calibrator.

U.S. Pat. No. 5,421,520 to Simonette et al. discloses a portable pressure washer.

U.S. Pat. No. 4,123,004 to Jerry discloses a car hand spray washer.

While these devices fulfill their respective, particular objective and requirements, the aforementioned patents do not describe a high pressure water sprayer for inserting the shaft of the apparatus underground to deliver water directly to plant and tree roots.

In this respect, the high pressure water sprayer according to the present invention substantially departs from the conventional concepts and designs of the prior art, and in doing so provides an apparatus primarily developed for the purpose of inserting the shaft of the apparatus underground to deliver water directly to plant and tree roots.

Therefore, it can be appreciated that there exists a continuing need for new and improved high pressure water sprayer which can be used for inserting the shaft of the apparatus underground to deliver water directly to plant and tree roots. In this regard, the present invention substantially fulfills this need.

SUMMARY OF THE INVENTION

In the view of the foregoing disadvantages inherent in the known types of sprayers now present in the prior art, the present invention provides an improved high pressure water sprayer. As such, the general purpose of the present invention, which will be described subsequently in greater detail, is to provide a new and improved high pressure water sprayer and method which has all the advantages of the prior art and none of the disadvantages.

To attain this, the present invention essentially comprises a new and improved high pressure water sprayer adapted for use in association with a tree having subterranean roots and liquid fertilizer, the apparatus comprising, in combination: a garden hose formed in a tubular configuration and having a first end including male screw threads, in an operative orientation the garden hose being coupled to a water source; a shaft fabricated of PVC pipe and formed in a hollow elongated cylindrical configuration with inboard and outboard ends each including male screw threads; a spray nozzle having an inboard region including female screw threads and an outboard region formed in a generally conical configuration with a plurality of apertures therethrough, in an operative orientation the inboard region of the spray nozzle being threadedly coupled to the outboard end of the shaft; a first adapter formed in a generally cylindrical configuration with a hollow interior, the adapter having an inboard end including male screw threads and an outboard end including female screw threads, in an operative orientation the outboard end of the first adapter being threadly coupled to the inboard end of the shaft; a lid assembly having an upper region formed as a cylindrical tube with a hollow interior and a lower region formed as a generally circular cover, the cover having an inner surface including internal screw threads and a short pipette and a long pipette extending therefrom, the cylindrical tube having inboard and outboard ends each including female screw threads, each pipette having an upper region in communication with the hollow interior of the cylindrical tube, the outboard end of the cylindrical tube being threadedly coupled to the inboard end of the first adapter; a liquid retention jar formed in a generally cylindrical configuration with a closed bottom, an open top and a hollow interior, the open top including external screw threads positioned therearound, the open top of the liquid retention jar adapted to be coupled to the inner surface of the cover; a second adapter formed in a generally cylindrical configuration with a hollow interior, the adapter having an inboard end including female screw threads and an outboard end including male screw threads, in an operative orientation the outboard end of the second adapter being threadedly coupled to the inboard end of the upper region of the lid assembly; a quick connector formed in a generally cylindrical configuration with an outboard end, an inboard end, an exterior surface, a hollow interior and an internal diameter, the outboard end including male screw threads and being threadedly coupled to the inboard end of the second adapter, the inboard end of the quick connector including female screw threads and adapted to be threadedly coupled to a garden hose; and a regulator disc with a diameter approximately equal to the internal diameter of the quick connector and including a radially positioned aperture, an axle affixed within aperture of the quick connector, a handle positioned on the exterior surface of the quick connector, the handle operatively coupled to the axle and regulator disc, the handle having an closed orientation and an open orientation, in an operative orientation a user coupling the quick connector to a garden hose and placing liquid fertilizer in the liquid retention jar, the user then placing shaft and spray nozzle underground, the user then activating the apparatus by placing the handle in the open orientation thereby allowing water to flow through the quick connector past the regulator disc into the second adapter, the water then flowing through the inboard end of the lid assembly and down the short pipette into the liquid retention jar, in the liquid retention jar the water mixing with the liquid fertilizer and being propelled up through the long pipette into the outboard end of the lid assembly, the water then travelling through the first adapter into the shaft and out through the spray nozzle, the water being propelled through the apparatus at a velocity enabling a user to water the roots of trees.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved high pressure water sprayer which has all the advantages of the prior art sprayers and none of the disadvantages.

It is another object of the present invention to provide a new and improved high pressure water sprayer which may be easily and efficiently manufactured and marketed.

It is a further object of the present invention to provide a new and improved high pressure water sprayer which is of durable and reliable construction.

An even further object of the present invention is to provide a new and improved high pressure water sprayer which is susceptible of a low cost of manufacture with regard to both materials and labor, and which accordingly is then susceptible of low prices of sale to the consuming public, thereby making such a high pressure water sprayer economically available to the buying public.

Still yet another object of the present invention is to provide a new and improved high pressure water sprayer which provides in the apparatuses and methods of the prior art some of the advantages thereof, while simultaneously overcoming some of the disadvantages normally associated therewith.

Even still another object of the present invention is to provide a new and improved high pressure water sprayer for inserting the shaft of the apparatus underground to deliver water directly to plant and tree roots.

Lastly, it is an object of the present invention to provide a new and improved high pressure water sprayer adapted for use in association with a garden hose, a tree having subterranean roots and liquid fertilizer, the apparatus comprising: a shaft formed in a hollow cylindrical configuration with inboard and outboard ends each including coupling means; a spray nozzle having an inboard region coupled to the shaft and an outboard region including a plurality of apertures therethrough; a quick connector having an outboard end including coupling means and being coupled to the shaft, the quick connector having an inboard end including coupling means and adapted to be coupled to a garden hose; and a regulator disc including an axle affixed thereto, a handle operatively coupled to the axle and regulator disc, in an operative orientation a user coupling the quick connector to a garden hose, the user then activating the apparatus thereby allowing water to flow through the quick connector into the shaft and out through the spray nozzle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along section line 3—3 of FIG. 2 illustrating the configuration of the lid assembly and liquid retention jar.

FIG. 4 is a cross sectional view taken along section line 4—4 of FIG. 3 illustrating the configuration of the quick connector.

The same reference numerals refer to the same parts through the various Figures.

DESCRIPTION OF THE PREFERRED EMBODIMENT

Figures 1, 2:
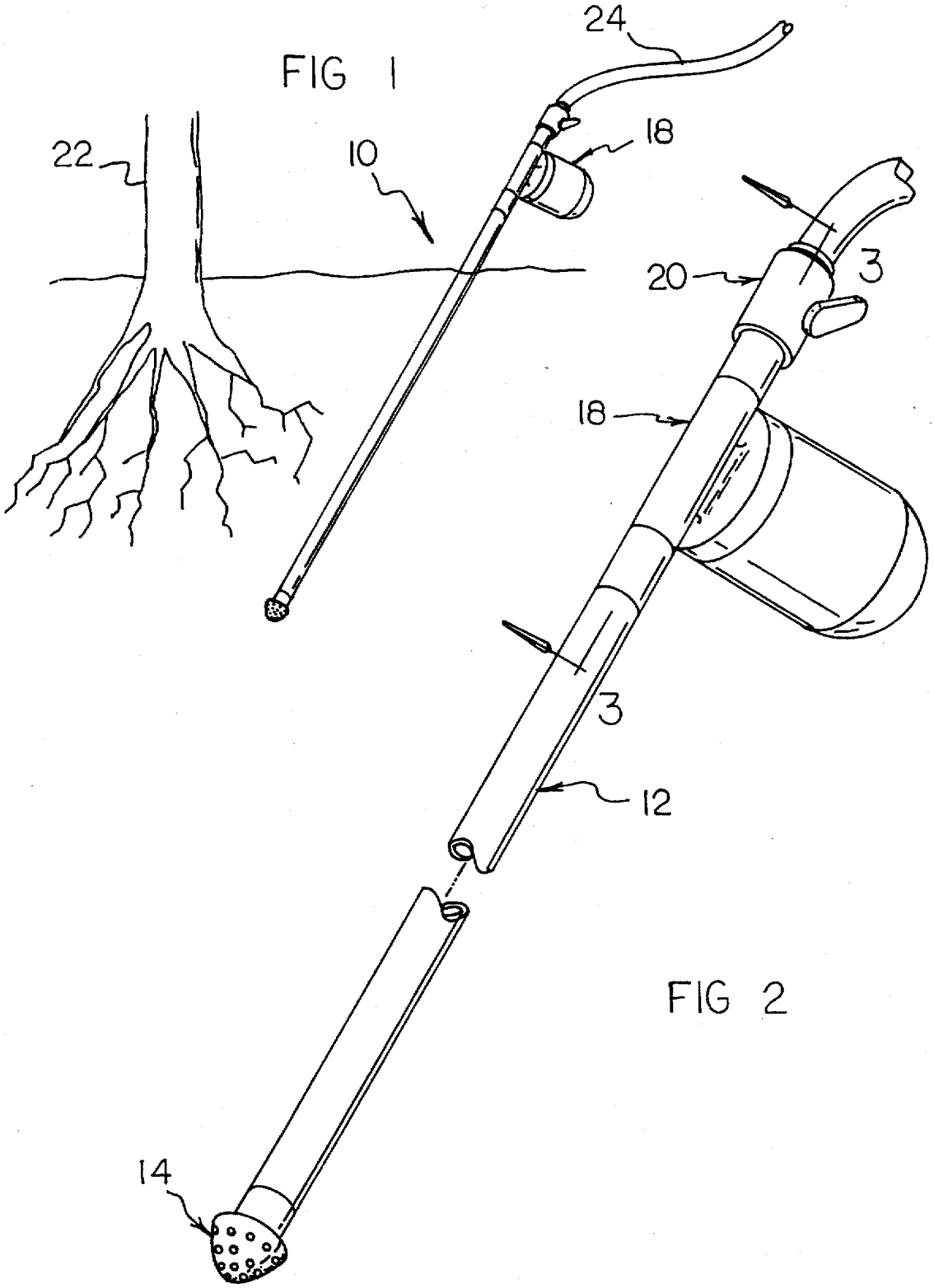
FIG. 1 is a perspective view of the preferred embodiment of the high pressure water sprayer constructed in accordance with the principles of the present invention.
FIG. 2 is an isolated perspective view of the apparatus.

With reference now to the drawings, and in particular, to FIG. 1 thereof, the preferred embodiment of the new and improved high pressure water sprayer embodying the principles and concepts of the present invention and generally designated by the reference number 10 will be described.

Specifically, it will be noted in the various Figures that the device relates to a high pressure water sprayer 10 to deliver water directly to plant and tree roots. In its broadest context, the device consists of a shaft 12, a spray nozzle 14, a lid assembly 18, and a quick connector 20. Such components are individually configured and correlated with respect to each other so as to attain the desired objective.

The high pressure water sprayer is adapted for use in association with a tree 22 having subterranean roots. The apparatus can also be utilized with plants species having above ground roots. In the preferred embodiment liquid fertilizer is positioned within the liquid retention jar. Solid fertilizer mixed with water could also be used with the apparatus. In alternate embodiments detergent is positioned within the liquid retention jar. In such embodiments the apparatus is utilized to pressure wash windows and cars. Note FIG. 1.

A garden hose 24 is included with the apparatus. The garden hose is formed in an elongated tubular configuration and has a first end including male screw threads. In an operative orientation the garden hose is coupled to a water source such as the spigot of a house. Note FIG. 1.

Figure 5:
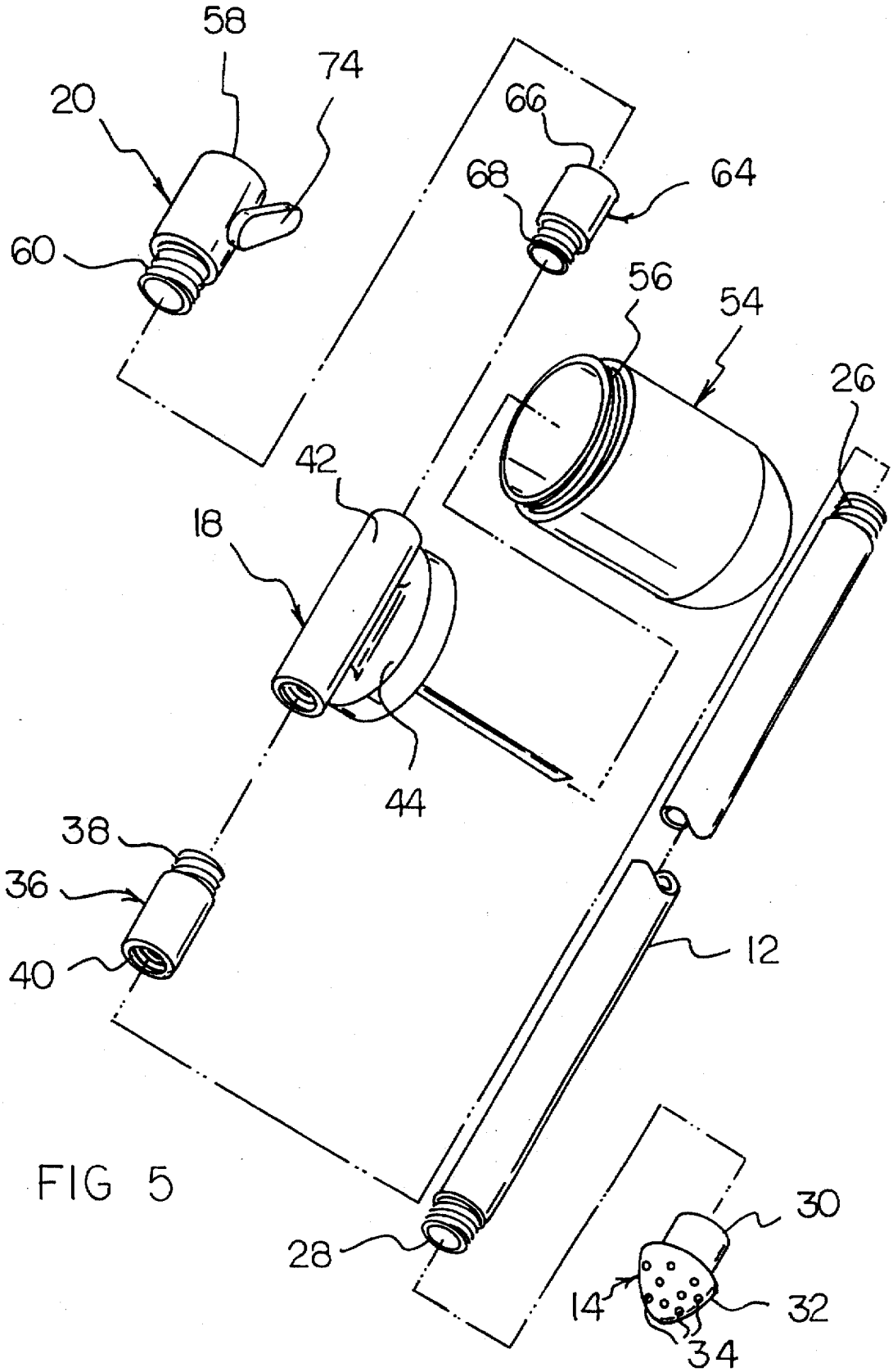
FIG. 5 is a separated perspective view of the apparatus illustrating the positioning of the various components with respect to each other.

The shaft is fabricated of PVC pipe and is formed in a hollow elongated cylindrical configuration. In the preferred embodiment a four foot piece of ¼" PVC pipe is used. The shaft has inboard 26 and outboard 28 ends, each end including male screw threads. Note FIG. 2 and 5.

The spray nozzle 14 has an inboard region 30 including female screw threads and an outboard region 32. The outboard region is formed in a generally conical configuration with a plurality of apertures 34. In an operative orientation the inboard region 30 of the spray nozzle is threadedly coupled to the outboard end 28 of the shaft. Note FIGS. 2 and 5.

A first adapter 36 is formed in a generally cylindrical configuration with a hollow interior. The adapter has a diameter of ¼ inch and a length of ¾ inch. The adapter has an inboard end 38 including male screw threads and an outboard 40 end including female screw threads. In an operative orientation the outboard end of the first adapter is threadly coupled to the inboard end 26 of the shaft. Note FIGS. 3 and 5.

A lid assembly 18 has an upper region formed as a cylindrical tube 42 with a hollow interior and a lower region formed as a generally circular cover 44. The cover has an inner surface including internal screw threads. Extending from the cover are a short pipette 46 and a long pipette 48. The cylindrical tube has inboard 50 and outboard 52 ends. Each of the ends include female screw threads. Each pipette has an upper region in communication with the hollow interior of the cylindrical tube. The outboard end 52 of the cylindrical tube is threadedly coupled to the inboard end 38 of the first adapter. Note FIGS. 3 and 5.

A liquid retention jar 54 is formed in a generally cylindrical configuration with a closed bottom, an open top and a hollow interior. The circumference of the open top includes external screw threads 56. The open top of the liquid retention jar is adapted to be coupled to the inner surface of the cover 44. Note FIG. 3.

A second adapter 64 is formed in a generally cylindrical configuration with a hollow interior. The adapter has a diameter of ¼ inch and a length of ¾ inch. The adapter has an inboard end 66 which includes female screw threads and an outboard end 68 including male screw threads. In an operative orientation the outboard end 68 of the second adapter is threadedly coupled to the inboard end 50 of the upper region of the lid assembly. Note FIGS. 3 and 5.

The quick connector 20 is formed in a generally cylindrical configuration with an outboard end 58 and an inboard end 60. The quick connector further includes an exterior surface, a hollow interior 62 and an internal diameter. The outboard end 58 includes male screw threads and is threadedly coupled to the inboard end 66 of the second adapter 64. The inboard end 60 of the quick connector includes female screw threads and is adapted to be threadedly coupled to the a garden hose 24. Note FIG. 2.

A regulator disc 70 has a diameter approximately equal to the internal diameter of the quick connector 20. The regulator disc includes a radially positioned aperture. An axle 72 is affixed within aperture of the quick connector. A handle 74 is positioned on the exterior surface of the quick connector. The handle is operatively coupled to the axle 72 and regulator disc 70. The handle has an closed orientation and an open orientation. Note FIGS. 3 and 4.

In an operative orientation a user couples the quick connector to a garden hose and places liquid fertilizer in the liquid retention jar. The user then places the shaft and spray nozzle underground. The user then activates the apparatus by placing the handle in the open orientation. This action allows water to flow through the quick connector 20 past the regulator disc 70 into the second adapter 64. The position of the disc causes a decrease in the cross sectional area of the quick connector. In conformity with Bernouli's Principle the reduced cross sectional area of the quick connector causes the velocity of the water to increase. Note FIG. 3.

The water then flows through the inboard end 50 of the lid assembly 18 and down the short pipette 46 into the liquid retention jar 54. In the liquid retention jar the water mixes with the liquid fertilizer and is propelled up through the long pipette 48 into the outboard end 52 of the lid assembly. The water then travels through the first adapter 36 into the shaft 12 and out through the spray nozzle 14. The water is propelled through the apparatus at a high velocity. This facilitates a user's ability to tunnel through ground soil to access plant and tree roots. It also enables a user to perform high pressure car and window washes. Note FIG. 1.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved high pressure water sprayer adapted for use in association with a tree having subterranean roots and liquid fertilizer, the apparatus comprising, in combination:

a garden hose formed in a tubular configuration and having a first end including male screw threads, in an operative orientation the garden hose being coupled to a water source;

a shaft fabricated of PVC pipe and formed in a hollow elongated cylindrical configuration with inboard and outboard ends each including male screw threads, the shaft having a length of four feet and a diameter of ¼ inches;

a spray nozzle having an inboard region including female screw threads and an outboard region formed in a generally conical configuration with a plurality of apertures therethrough, in an operative orientation the inboard region of the spray nozzle being threadedly coupled to the outboard end of the shaft;

a first adapter formed in a generally cylindrical configuration with a hollow interior, the first adapter having a diameter of ¼ inch and a length of ¾ inch, the adapter having an inboard end including male screw threads and an outboard end including female screw threads, in an operative orientation the outboard end of the first adapter being threadedly coupled to the inboard end of the shaft;

a lid assembly having an upper region formed as a cylindrical tube with a hollow interior and a lower region formed as a generally circular cover, the cover having an inner surface including internal screw threads and a short pipette and a long pipette extending therefrom, the cylindrical tube having inboard and outboard ends each including female screw threads, each pipette having an upper region in communication with the hollow interior of the cylindrical tube, the outboard end of the cylindrical tube being threadedly coupled to the inboard end of the first adapter;

a liquid retention jar formed in a generally cylindrical configuration with a closed bottom, an open top and a hollow interior, the open top including external screw threads positioned therearound, the open top of the liquid retention jar adapted to be coupled to the inner surface of the cover;

a second adapter formed in a generally cylindrical configuration with a hollow interior, the second adapter having a diameter of ¼ inch and a length of ¾ inches, the adapter having an inboard end including female screw threads and an outboard end including male screw threads, in an operative orientation the outboard end of the second adapter being threadedly coupled to the inboard end of the upper region of the lid assembly;

a quick connector formed in a generally cylindrical configuration with an outboard end, an inboard end, an exterior surface, a hollow interior and an internal diameter, the outboard end including male screw threads and being threadedly coupled to the inboard end of the second adapter, the inboard end of the quick connector including female screw threads and adapted to be threadedly coupled to a garden hose; and a regulator disc with a diameter approximately equal to the internal diameter of the quick connector and including a radially positioned aperture, an axle affixed within aperture of the quick connector, a handle positioned on the exterior surface of the quick connector, the handle operatively coupled to the axle and regulator disc, the handle having an closed orientation and an open orientation, in an operative orientation a user coupling the quick connector to a garden hose and placing liquid fertilizer in the liquid retention jar, the user then placing shaft and spray nozzle underground, the user then activating the apparatus by placing the handle in the open orientation thereby allowing water to flow through the quick connector past the regulator disc into the second adapter, the water then flowing through the inboard end of the lid assembly and down the short pipette into the liquid retention jar, in the liquid retention jar the water mixing with the liquid fertilizer and being propelled up through the long pipette into the outboard end of the lid assembly, the water then travelling through the first adapter into the shaft and out through the spray nozzle, the water being propelled through the apparatus at a velocity enabling a user to water the roots of trees.

* * * * *